US005102354A

United States Patent [19]

Crane et al.

[11] Patent Number: 5,102,354

[45] Date of Patent: Apr. 7, 1992

[54] FILTER CONNECTOR

[75] Inventors: Burke J. Crane, Lombard; Jeffrey J. Pawlicki, Downers Grove; Timothy R. Ponn, Aurora, all of Ill.

[73] Assignee: Molex Incorporated, Lisle, Ill.

[21] Appl. No.: 679,499

[22] Filed: Mar. 2, 1991

[51] Int. Cl.[5] ..... H01R 13/66

[52] U.S. Cl. ..... 439/620; 439/607

[58] Field of Search ..... 439/620, 97, 101, 181-185, 439/607-610; 333/181, 183, 184, 185

[56] References Cited

U.S. PATENT DOCUMENTS

| | | | |
|---|---|---|---|
| 4,690,479 | 9/1987 | Hollyday et al. | 439/620 |
| 4,772,224 | 9/1988 | Talend | 439/620 |
| 4,884,982 | 12/1989 | Fleming et al. | 439/620 |
| 4,929,196 | 5/1990 | Ponn et al. | 439/620 |
| 4,934,960 | 6/1990 | Capp et al. | 439/620 |

FOREIGN PATENT DOCUMENTS

| | | | |
|---|---|---|---|
| 2086151 | 5/1982 | United Kingdom | 439/620 |

*Primary Examiner*—David L. Pirlot

*Attorney, Agent, or Firm*—A. A. Tirva; Stephen Z. Weiss; Charles S. Cohen

[57] ABSTRACT

A filter connector is provided with a housing and at least one electrically conductive terminal on the housing. A ground plate is provided on the housing in spaced relationship to the terminal. A capacitor is electrically connected to the ground plate. An electrically conductive spring is coupled between the terminal and the capacitor. The spring is mounted for free movement relative to the housing to isolate the capacitor from terminal vibrations or shocks.

14 Claims, 3 Drawing Sheets

FILTER CONNECTOR

FIELD OF THE INVENTION

This invention generally relates to the art of electrical connectors and, particularly, to a filter connector adapted for use in automotive environments.

BACKGROUND OF THE INVENTION

The number of electrical components in automotive vehicles have increased substantially in recent years. Trends suggest that the number and complexity of electrical components in vehicles will continue to increase. Many of the electrical components incorporated into automotive vehicles include a plurality of input/output signal carrying lines. For example, a typical automotive radio will include input/output lines extending to an illuminated radio dial, an electric clock incorporated into the radio dial and various power operated controls on the radio. The input/output lines for electrical components on a vehicle generally extend from a printed circuit board to an electrical connector having a plurality of terminals mounted therein. The leads extending from the circuit board to the connector are likely to generate or receive electrical interference, e.g., EMI/RFI. For example, the signals generated by an automotive radio may affect or be affected by other electronic components of the vehicle, such as CB radios, electronic fuel injection systems and electronic braking controls. Additionally, interference generated by electric components on one vehicle conceivably can affect the performance of electrical components on another vehicle. The affects of electrical interference on an automotive radio can be an annoying problem. On the other hand, the affects of electrical interference on an electronic fuel injection system or an electronic braking control could be catastrophic.

Most prior art vehicular radios and other electrical automotive components include capacitors, ferrite suppressors or other such filter means incorporated into the circuitry printed on the circuit board. Although these known suppressors and filters are effective to minimize interference generated on the circuit board, they are of limited effectiveness in filtering signals in the input/output lines leading to or extending from the circuit board. These signal lines external to the circuit board now are known to generate and/or receive a very significant portion of the electrical interference.

The prior art includes filters mounted on portions of signal carrying circuits external to a circuit board. These prior art attempts have shared several significant deficiencies. In particular, most prior art electrical interference filters disposed at locations external to a circuit board have been complex and relatively expensive. Additionally, these complex prior art filters have not been well suited to long term use in a automotive environment, and are subject to failure in such an environment.

In order to solve these problems, an improved filter connector was designed as shown in U.S. Pat. No. 4,929,196, dated May 29, 1990 and assigned to the assignee of this invention. In that patent, a filter connector is provided for incorporation into a signal line of an electrical component used in a high vibration environment, such as an automotive radio. The filter connector comprises a filtering assembly having a plurality of terminals disposed in spaced relationship to a grounding plate. Chip capacitors, capacitor arrays or similar capacitor means are mounted to the grounding plate. Electrical connection is provided between the capacitors and the respective terminals. Portions of the filtering assembly including the capacitors, the grounding plate and areas on the terminals connected to the capacitors are insert molded in a nonconductive housing. As a result, the nonconductive housing defines a unitary three-dimensional nonconductive matrix which surrounds, supports and protects the various interconnected components of the filtering assembly, and prevents damage in the high vibration automotive environment. Although the filter connector of this patent shows L-shaped members coupling the terminals to the capacitors, the originally resilient members eventually are substantially encapsulated by the insert molded material which provides the primary means to prevent damage as a result of the high vibration environment.

This invention is directed to further improvements in filter connectors to solve the problems caused in high vibration environments.

SUMMARY OF THE INVENTION

An object, therefore, of the invention is to provide a new and improved filter connector that is well suited for use in a high vibration environment, such as in automotive applications and the like.

In the exemplary embodiment of the invention, the filter connector includes housing means with at least one electrically conductive terminal thereon. Ground means are provided on the housing means in spaced relationship to the terminal. A capacitor is electrically connected to the ground means. Electrically conductive spring means is coupled between the terminal and the capacitor. The spring means is mounted for free movement relative to the housing to isolate the capacitor from terminal vibrations or shocks.

As disclosed herein, the electrically conductive terminal is rigid with the housing means and may be insert molded in the housing means. The ground means is generally L-shaped, with the capacitor electrically connected to one leg of the L-shape and the terminal extending through an enlarged opening in the other leg of the L-shape.

In the preferred embodiment of the invention, the electrically conductive spring means is provided in the form of a generally S-shaped metal spring defining free ends electrically connected to the terminal and the capacitor. The spring may be stamped and formed from sheet material whereby the free ends present substantial planar surfaces for connection to the terminal and the capacitor. Preferably, conductive adhesive is used to electrically connect the free ends of the spring to the terminal and the capacitor and to electrically connect the capacitor to the ground means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION

Figure 1:
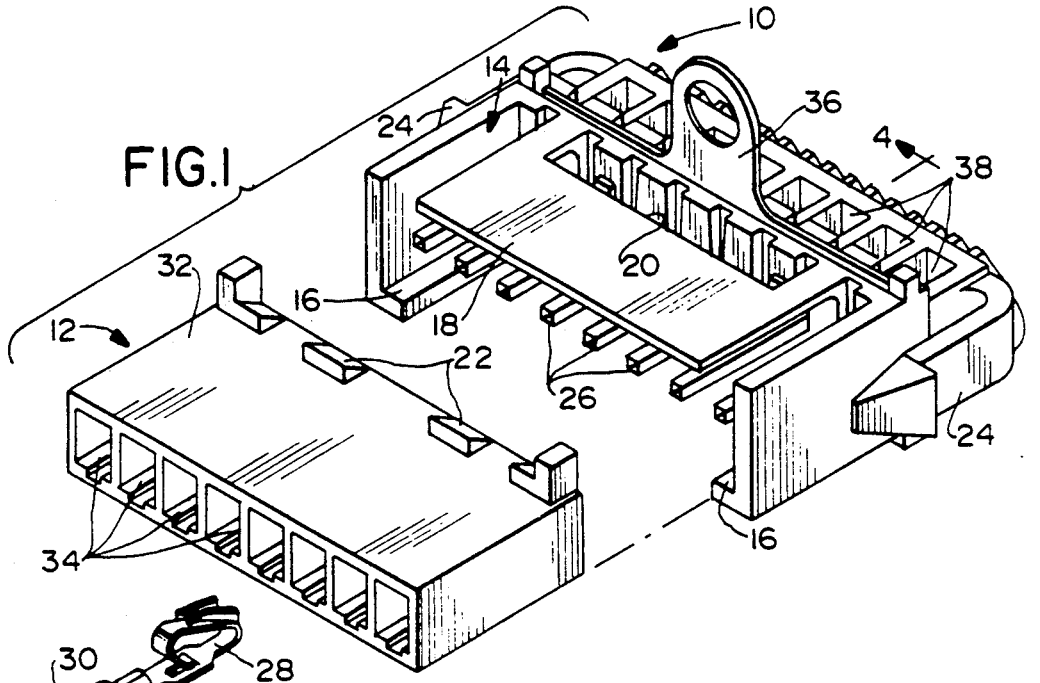
FIG. 1 is an exploded perspective view of an electrical connector assembly embodying the concepts of the invention.

Referring to the drawings in greater detail, and first to FIG. 1, the invention is illustrated herein as embodied in a filter connector, generally designated 10, which is a "pin connector" for mating with a complementary receptacle connector, generally designated 12. Filter connector 10 is intended for application in environments to minimize the affect of electrical interference on the signal carrying leads to or from respective components, such as the input and/or output signal lines of a radio in an automobile, and to prevent the leads from generating electrical interference that could affect other electrical components in the environment. The filter connector is well suited for use in a high vibration environment such as automotive environments and the like.

As shown in FIG. 1, filter connector 10 includes a unitarily molded insulating housing, generally designated 14, of dielectric material such as plastic or the like. The housing defines guide means 16 for receiving receptacle connector 12, along with a resilient latch wall 18 which has a transversely elongated latching slot 20 for latching behind latch bosses 22 on top of receptacle connector 12, as will be seen in greater detail hereinafter. Housing 14 also has side latch arms 24 for locking engagement of the connector in an appropriate opening in a panel (not shown) or the like.

FIG. 1 also shows that filter connector 10 has a plurality of terminal pins 26 which define signal carrying leads and which are connectable to a plurality of electrical contacts 28 of receptacle connector 12, only one contact 28 being shown in FIG. 1, but with each contact being terminated to a lead wire 30. Although only one contact 28 and wire 30 are shown in FIG. 1, it can be seen that receptacle connector 12 has a unitarily molded housing 32 provided with a plurality of through cavities 34 for receiving a corresponding plurality of contacts 28 for mating with terminal pins 26 of filter connector 10. This will be seen in greater detail hereinafter in the description of FIG. 4. Lastly, filter connector 10 includes a ground plate 36 extending across housing 14 transversely of terminal pins 26 adjacent a row of vertically oriented openings 38.

Figure 2:
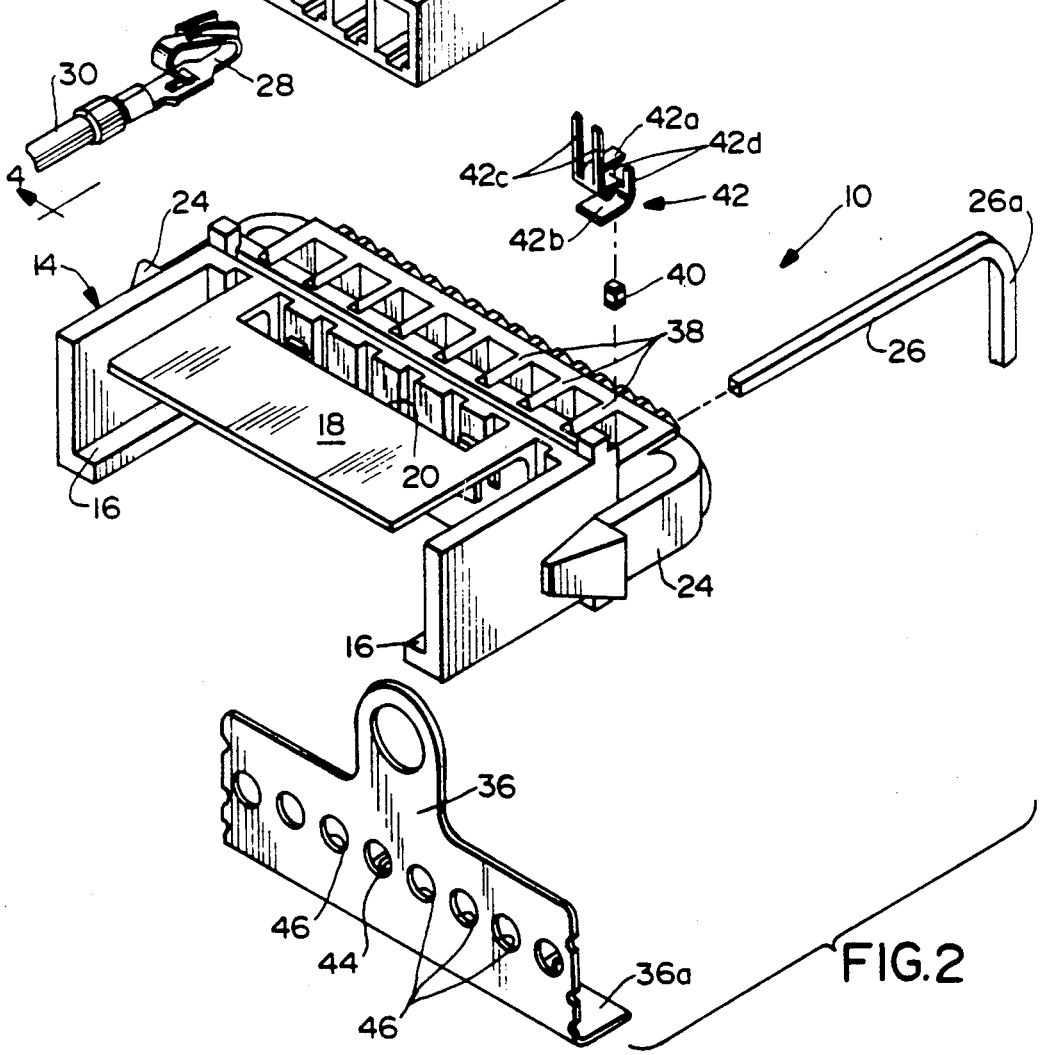
FIG. 2 is an exploded perspective view of the components of the right-hand connector shown in the assembly of FIG. 1.

FIG. 2 shows the components of filter connector 10, including housing 14, ground plate 36 and one of the terminal pins 26. It can be seen that each terminal pin 26 is generally L-shaped, defining a depending leg or tail portion 26*a*. In addition, a chip capacitor 40 and an electrically conductive spring, generally designated 42, are provided for each terminal pin 26. The capacitor and the spring are assembled into housing 14 downwardly through openings 38.

As will be seen in greater detail, each spring 42 is generally S-shaped, defining free spring ends 42*a* and 42*b*. However, FIG. 2 most clearly shows that the spring also has two pairs of upwardly directed arms 42*c* and 42*d*, respectively between. The respective terminal pin 26 is inserted through the one pair of arms 42*c*.

Figure 3:
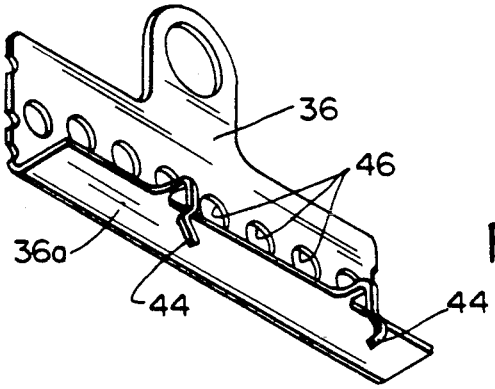
FIG. 3 is a perspective view of the ground plate, reversed from the direction shown in FIG. 2.

Referring to FIG. 3 in conjunction with FIG. 2, ground plate 36 is generally L-shaped in cross-section, with the major plane of the plate defining one leg of the L-shape and a lower flange 36*a* forming the other leg of the L-shape. As seen in FIG. 3, a pair of board-lock tails 44 project downwardly from flange 36*a* of ground plate 36. The ground plate has a plurality of enlarged openings 46 through which terminal pins 26 protrude. Both ground plate 36 and spring 42 are fabricated unitarily of stamped and formed conductive material, such as metal or the like.

Figure 4:
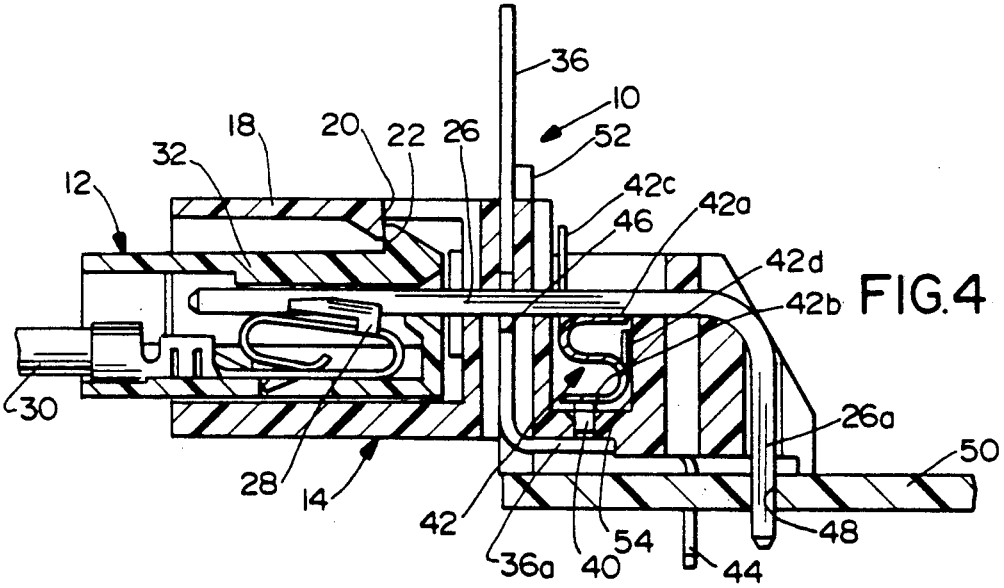
FIG. 4 is a vertical section taken generally along line 4—4 of FIG. 1, but with the connectors of FIG. 1 interconnected.

FIG. 4 shows filter connector 10 mated with receptacle connector 12, and with terminal pins 26 interconnected with contacts 28 terminated to lead wires 30. It can be seen that latch bosses 22 of receptacle connector housing 32 are snapped into opening 20 in resilient latch wall 18 of filter connector housing 14. It also can be seen in FIG. 4 that tail portion 26*a* of terminal 26 projects through an opening 48 in a printed circuit board 50 for connection to appropriate circuit trace means (not shown) on the printed circuit board, and that board-lock tails 44 of ground plate 36 also project through the printed circuit board for coupling to ground traces (not shown) on the board.

The invention contemplates isolating each capacitor 40 from any vibrations or shocks incurred by or imposed upon terminals 26 either during mating or unmating of the connectors or from other sources, such as automotive vibrations, handling or other manipulations.

More particularly, as seen in FIG. 4, capacitor 40 is sandwiched between flange 36*a* of ground plane 36 and leg 42*b* of S-shaped spring 42. Since both flange 36*a* and leg 42*b* are planar, substantial areas of contact are made with opposite sides of the capacitor. The upper leg 42*a* of S-shaped spring 42 is in engagement with terminal pin 26. Opposite sides of capacitor 40 can be electrically coupled to flange 36*a* of the ground plate and to leg 42*b* of the spring, and leg 42*a* of the spring can be electrically coupled to terminal pin 26 by appropriate means, such as soldering or the like. However, in the preferred embodiment, it is contemplated that these interconnections be made by conductive adhesive.

It can be seen in FIG. 4 that terminal pin 26 is spaced considerably from enlarged opening 46 through ground plate 26. Therefore, any movement or vibration of the terminal pin can be transmitted to capacitor 40 only through S-shaped spring 42. This substantially isolates the capacitor from any terminal vibrations or shocks. In addition, upper arms 42*c* and lower arms 42*d* are spaced from walls 52 and 54, respectively, of housing 14 to prevent over-stressing of the spring, generally in the longitudinal direction of mating and unmating of terminal pin 26.

Figure 6:
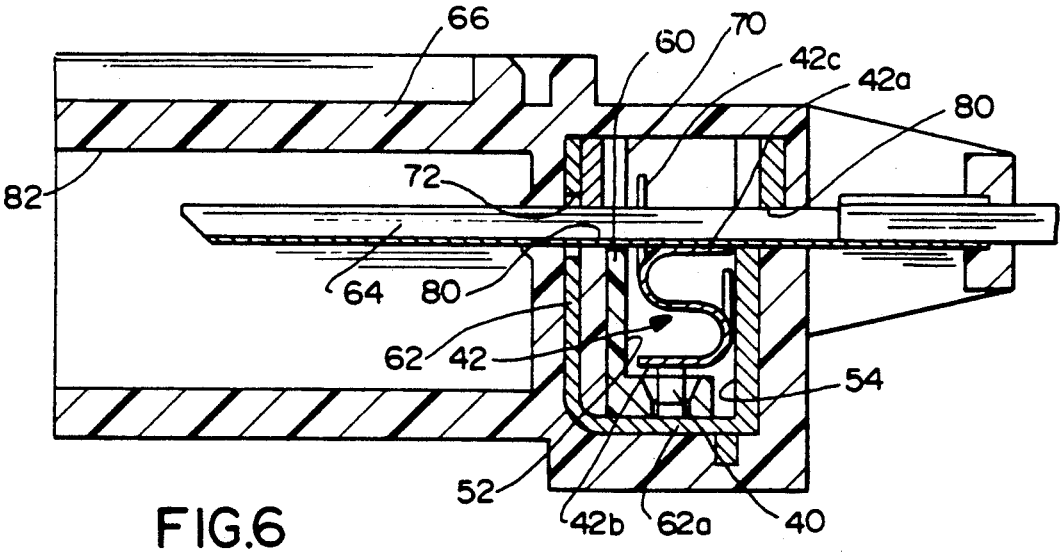
FIG. 6 is a vertical section through the assembled connector of the components shown in the alternative form of FIG. 5.
Figure 5:
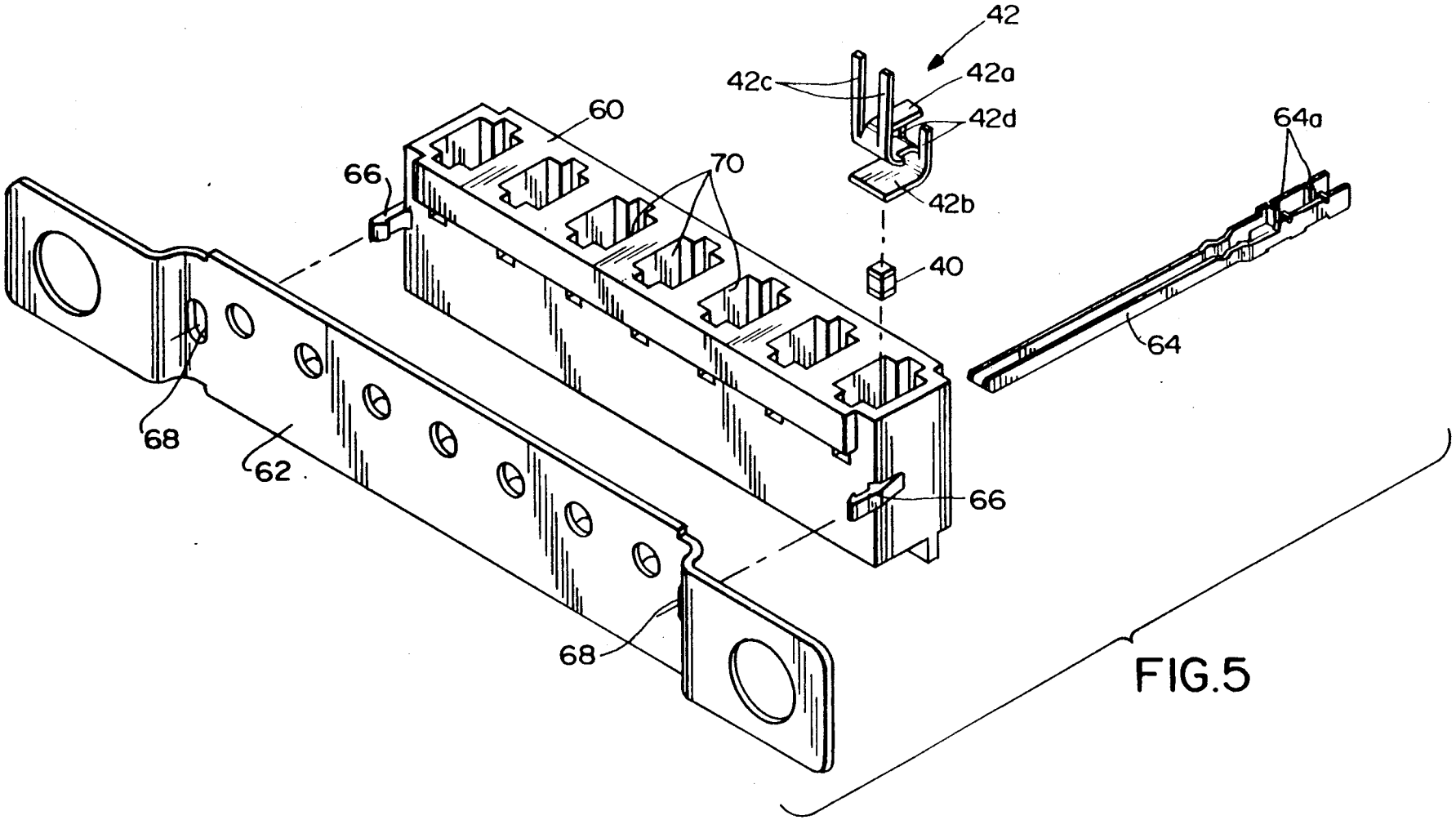
FIG. 5 is an exploded perspective view of the components of an alternate form of connector embodying the concepts of the invention.

FIGS. 5 and 6 show an alternate form of the invention wherein an insert housing 60, a ground plate 62, a plurality of terminals 64, a plurality of chip capacitors 40 and a plurality of S-shaped springs 42 all are insert molded in a filter connector housing 66 (FIG. 6). The general concepts of the invention involving the use of S-shaped spring 42 to isolate capacitors 40 from terminal vibrations or shocks are generally incorporated in the embodiment of FIGS. 5 and 6. It can be seen in FIG. 5 that terminal 64 is a stamped and formed component including insulation displacement means 64*a* for termination to a respective signal wire, versus the printed circuit board terminal pin 26 of the embodiment of FIGS. 1–4. It also can be seen that ground plate 62 is snap-fit onto one side of insert housing 60 by means of latch arms 66 on the housing and apertures 68 in the ground plate. Otherwise, insert housing 60 has vertically oriented openings 70 for receiving capacitors 40 and springs 42, and ground plate 62 has enlarged openings 72 through which terminals 64 protrude.

During assembly and referring to FIG. 6, ground plate 62 is snapped onto insert housing 60 to the position shown. The ground plate is generally L-shaped, defining a horizontal (as viewed in the drawings) flange 62*a* underlying housing 60. Capacitors 40 and S-shaped springs 42 are positioned into openings 70 as shown in FIG. 6 similar to the embodiment illustrated in FIG. 4. Terminals 64 then are inserted through holes 80 in housing 60 and through enlarged openings 72 in ground plate 62. Conductive adhesive is used to conductively interconnect capacitor 40 to flange 62*a* of the ground plate and to free end 42*b* of the spring, as well as to electrically interconnect free end 42*a* of the spring to terminal 64. This subassembly then is overmolded with filter connector housing 66 which includes a cavity 82 for receiving an appropriate receptacle connector.

While the overmolded housing 66 of the embodiment of the invention shown in FIGS. 5 and 6 provides considerable protection for the components in a high vibration environment, it can be seen that S-shaped springs 42 isolate capacitors 40 from terminal vibrations or shocks during assembly and handling.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A filter connector, comprising:

housing means;

an electrically conductive terminal on the housing means;

ground means on the housing in spaced relationship to the terminal;

a capacitor electrically connected to the ground means; and electrically conductive spring means coupled between the terminal and the capacitor, the spring means being mounted for free movement relative to the housing to isolate the capacitor from terminal vibrations and shocks and electrically connected to the terminal and ground means by conductive adhesive.

2. The filter connector of claim 1 wherein said ground means is generally L-shaped with the capacitor electrically connected to one leg of the L-shape and the terminal extending through an enlarged opening in the other leg of the L-shape.

3. The filter connector of claim 1, including conductive adhesive electrically connecting the capacitor to the ground means.

4. The filter connector of claim 1, including conductive adhesive electrically connecting the capacitor to the ground means.

5. The filter connector of claim 1 wherein said electrically conductive terminal is rigid with the housing means.

6. The filter connector of claim 5 wherein said electrically conductive terminal is insert molded in the housing means.

7. A filter connector, comprising:

housing means;

an electrically conductive terminal on the housing means;

ground means on the housing means in spaced relationship to the terminal;

a capacitor electrically connected to the ground means;

electrically conductive spring means coupled between the terminal and the capacitor, the spring means being mounted for free movement relative to the housing to isolate the capacitor from terminal vibrations and shocks; and wherein said electrically conductive spring means comprises a metal spring and wherein said metal spring is generally S-shaped defining free ends electrically connected to the terminal and to the capacitor.

8. The filter connector of claim 7, including conductive adhesive electrically connecting said free ends to the terminal and to the capacitor.

9. The filter connector of claim 1 wherein said electrically conductive spring means is fabricated of generally flat metal material in a generally S-shape defining generally planar free ends electrically connected to the terminal and to the capacitor.

10. The filter connector of claim 9, including conductive adhesive electrically connecting said free ends to the terminal and to the capacitor.

11. The filter connector of claim 10, including conductive adhesive electrically connecting the capacitor to the ground means.

12. A filter connector, comprising:

housing means;

an electrically conductive terminal on the housing means;

ground means on the housing means in spaced relationship to the terminal, the ground means being generally L-shaped with the terminal extending through an enlarged opening in one leg thereof;

a capacitor electrically connected to another leg of the generally L-shaped ground means; and electrically conductive spring means coupled between the terminal and the capacitor, the spring means being mounted for free movement relative to the housing to isolate the capacitor from terminal vibrations and shocks, the spring means being generally S-shaped defining free ends electrically connected to the terminal and to the capacitor.

13. The filter connector of claim 12, including conductive adhesive electrically connecting said free ends to the terminal and to the capacitor.

14. The filter connector of claim 13, including conductive adhesive electrically connecting the capacitor to the ground means.

* * * * *